US007948182B2

(12) United States Patent
Beck et al.

(10) Patent No.: US 7,948,182 B2
(45) Date of Patent: May 24, 2011

(54) LOW-PRESSURE GAS DISCHARGE LAMP WITH A REDUCED ARGON PROPORTION IN THE GAS FILLING

(75) Inventors: Martin Beck, Augsburg (DE); Jürgen Dichtl, Augsburg (DE); Roland Hoffmann, Augsburg (DE); Maria Hoffmann, legal representative, Augsburg (DE); Astrid Hoffmann, legal representative, Augsburg (DE); Kerstin Hoffmann, legal representative, Aystetten (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 386 days.

(21) Appl. No.: 11/989,524

(22) PCT Filed: Jul. 25, 2006

(86) PCT No.: PCT/EP2006/007343

§ 371 (c)(1),
(2), (4) Date: Jan. 28, 2008

(87) PCT Pub. No.: WO2007/012467

PCT Pub. Date: Feb. 1, 2007

(65) Prior Publication Data

US 2009/0284154 A1 Nov. 19, 2009

(30) Foreign Application Priority Data

Jul. 27, 2005 (DE) ..... 10 2005 035 191

(51) Int. Cl.
*H01J 61/20* (2006.01)
*H01J 17/26* (2006.01)

(52) U.S. Cl. ..... 313/642; 313/568; 313/572

(58) Field of Classification Search ..... 313/642, 313/568, 572

See application file for complete search history.

(56) References Cited

U.S. PATENT DOCUMENTS

| | | | | |
|---|---|---|---|---|
| 4,199,701 | A * | 4/1980 | Bhattacharya | 313/25 |
| 4,417,172 | A * | 11/1983 | Touhou et al. | 313/156 |
| 4,568,856 | A * | 2/1986 | Inoue et al. | 315/60 |
| 5,523,655 | A * | 6/1996 | Jennato et al. | 315/246 |
| 6,611,102 | B2 * | 8/2003 | Kimoto et al. | 313/637 |
| 6,803,724 | B2 * | 10/2004 | Choi et al. | 313/643 |
| 7,508,133 | B2 * | 3/2009 | Hara | 313/568 |
| 7,683,550 | B2 * | 3/2010 | Yamashita et al. | 313/642 |
| 7,786,674 | B2 * | 8/2010 | Tu | 313/641 |
| 2001/0030506 | A1 | 10/2001 | Lankhorst | |
| 2002/0130600 | A1 * | 9/2002 | Bigio et al. | 313/26 |
| 2005/0077829 | A1 * | 4/2005 | Iida et al. | 313/634 |
| 2005/0077830 | A1 * | 4/2005 | Yamashita et al. | 313/637 |
| 2005/0099109 | A1 * | 5/2005 | Chow | 313/485 |
| 2005/0231095 | A1 * | 10/2005 | Beck et al. | 313/490 |
| 2005/0265018 | A1 * | 12/2005 | Yasuda et al. | 362/216 |
| 2006/0008677 | A1 * | 1/2006 | Bewlay et al. | 428/702 |
| 2006/0022595 | A1 * | 2/2006 | Bewlay et al. | 313/623 |
| 2006/0033070 | A1 * | 2/2006 | Manivannan et al. | 252/62.56 |

(Continued)

FOREIGN PATENT DOCUMENTS

| | | |
|---|---|---|
| DE | 27 22 694 | 11/1978 |

(Continued)

*Primary Examiner* — Nimeshkumar D Patel
*Assistant Examiner* — Jacob Stern

(57) ABSTRACT

The invention relates to novel gas fillings of low-pressure gas discharge lamps for reducing the starting and arc drop voltages at low Hg vapor pressures. In favor of a mixture consisting of Ne and Kr, the Ar portion of the gas filling is considerably reduced.

7 Claims, 4 Drawing Sheets

U.S. PATENT DOCUMENTS

| | | | | |
|---|---|---|---|---|
| 2006/0071602 | A1* | 4/2006 | Sommerer et al. | 313/638 |
| 2006/0132042 | A1* | 6/2006 | Smith et al. | 313/638 |
| 2006/0132043 | A1* | 6/2006 | Srivastava et al. | 313/638 |
| 2006/0208635 | A1* | 9/2006 | Lenef et al. | 313/567 |
| 2006/0214581 | A1* | 9/2006 | Hara | 313/567 |
| 2008/0026283 | A1* | 1/2008 | Park et al. | 429/56 |
| 2008/0036382 | A1* | 2/2008 | Wolf et al. | 313/631 |
| 2008/0042577 | A1* | 2/2008 | Sommerer et al. | 313/638 |
| 2008/0143258 | A1* | 6/2008 | Yamashita et al. | 313/631 |
| 2008/0164813 | A1* | 7/2008 | Wittmann et al. | 313/579 |
| 2008/0278073 | A1* | 11/2008 | Beers et al. | 313/572 |
| 2009/0079324 | A1* | 3/2009 | Deme et al. | 313/489 |
| 2009/0174327 | A1* | 7/2009 | Gibson et al. | 313/562 |
| 2009/0284154 | A1* | 11/2009 | Beck et al. | 313/642 |
| 2010/0079068 | A1* | 4/2010 | Genz | 313/572 |

FOREIGN PATENT DOCUMENTS

| | | | |
|---|---|---|---|
| DE | 218 711 | | 2/1985 |
| EP | 0 307 037 | | 3/1989 |
| EP | 0 331 738 | | 9/1989 |
| GB | 1594683 | A * | 8/1981 |
| JP | 54 129772 | | 10/1979 |
| JP | 55 098456 | | 7/1980 |
| JP | 55 157850 | | 12/1980 |
| JP | 56 048059 | | 5/1981 |
| JP | 56 102061 | | 8/1981 |
| JP | 58 018859 | | 2/1983 |
| JP | 63 066840 | | 3/1988 |
| JP | 63 066840 | | 3/1998 |
| WO | WO 2004/018969 | | 9/2004 |
| WO | WO 2005/101453 | | 10/2005 |

* cited by examiner

LOW-PRESSURE GAS DISCHARGE LAMP WITH A REDUCED ARGON PROPORTION IN THE GAS FILLING

FIELD OF THE INVENTION

The present invention relates to a low-pressure gas discharge lamp having a new gas fill.

BACKGROUND OF THE INVENTION

In low-pressure gas discharge lamps, a discharge is ignited and maintained in a gaseous discharge medium, in order to generate UV light or—by way of a phosphor—visible light. The gas fill contained in a discharge vessel of the lamp generally contains mercury (Hg), which originates from a Hg source that is present in the discharge vessel. The addition of Hg must be adapted in such a way that a Hg vapor pressure which is favorable for the light generation efficiency results in long-termed lamp operation.

SUMMARY OF THE INVENTION

The invention is based on the technical problem of providing a low-pressure gas discharge lamp with a new gas fill, which widens the use or design options for low-pressure gas discharge lamps.

The invention relates to a low-pressure gas discharge lamp having a discharge vessel and a gas fill in the discharge vessel, characterized in that the gas fill consists of 25% by volume to 70% by volume Ne, up to 25% by volume Ar, up to 10% by volume further noble gases and standard impurities, remainder Kr.

Preferred configurations are given in the dependent claims. The inventors have assumed that under various conceivable circumstances, low-pressure gas discharge lamps are to work with relatively high long-term operating temperatures of the lamp overall or at least of a Hg source in the discharge vessel. The high temperatures of a Hg source may be design-related, which will be dealt with in more detail below. Therefore, they may occur even when the ambient temperatures and lamp temperatures are otherwise within normal ranges. In such situations, it must be possible for the lamps to be ignited at a Hg source temperature which is—by comparison—very much lower.

If the high temperature results under certain operating conditions of the lamp overall, in individual circumstances it may nevertheless be the case that the lamp is also to be ignited at very much lower temperatures. One example would be a low-pressure gas discharge lamp for exterior lighting in a relatively closed luminaire housing, in which on the one hand during long-term operation a considerably higher temperature than the outside temperature is established, on account of the power loss from the lamp, but in which on the other hand low temperatures are present after prolonged periods of being switched off.

In these cases, the situation may arise whereby the Hg source, which is designed for the high temperatures during operation, in the event of an attempt to ignite the source under relatively cold conditions, provides a Hg vapor pressure which is so low that relatively high ignition voltages occur with conventional gas fills. These high ignition voltages require more complex ballast structures or may even place excessive demands on ballasts, i.e. lead to ignition attempts failing or to instability during dimming operation.

Similar statements apply to relatively low dimming levels of dimmable lamps, at which a correspondingly low level of heat loss is generated and accordingly, in a similar way to a start under cold conditions, relatively low temperatures of the lamp overall or of the Hg source inside it may result.

The gas fill described above has a greatly reduced Ar content compared to the prior art and a much higher Kr and Ne content, and solves the problems described.

It is possible to put together suitable mixtures within the ranges indicated according to the individual conditions with regard to temperature, the required light yield, the permissible or desired operating voltage and other aspects. The invention does not necessarily envisage Ar being completely replaced by Kr and Ne, although this is an option that is included given that the lower limit for Ar is 0% by volume. However, a certain amount of Ar improves the light yield, which means that an Ar content of at least 2% by volume, preferably 4%, particularly preferably 5% by volume is preferred. On the other hand, in view of the fundamental objective of the invention, the Ar content should not be too high, specifically should preferably be no more than 20% by volume, particularly preferably no more than 17 or 15% by volume.

It is of no interest to lower the operating voltage excessively, and consequently the Kr content should not be too high. It has been found that Kr lowers the operating voltage, whereas Ne increases it. When adapting a gas fill according to the invention, the two constituents should be varied in opposite directions. There should preferably be at least 35% by volume, particularly preferably 40% by volume, 44% by volume, 46% by volume and 48% by volume, with the limit values listed, both here and elsewhere, being increasingly preferred in the order indicated. However, the Ne content, in order for the operating voltage not to become too high, should preferably be no more than 65% by volume, particularly preferably 60% by volume or 57% by volume.

According to the invention, the remainder of the gas fill may correspond completely to Kr, of course including standard impurities. However, within the scope of the invention it is also quite possible, although not preferred, for a certain proportion of the remainder to be formed by other noble gases. This proportion of further noble gases, including standard impurities, preferably amounts to no more than 8% by volume, particularly preferably no more than 6% by volume, 4% by volume or 2% by volume.

A temperature range which is of relevance to the Hg source which regulates the vapor pressure in the lamp according to the invention is between 100° C. and 170° C. Conventional Hg amalgams may present difficulties in this range, because they set an excessively high Hg vapor pressure. Therefore, the invention is particularly suitable for a combination of the gas fill with a Hg amalgam and a masteralloy, the masteralloy corresponding to the general formula $$In_{a-e}X_bY_cZ_dR_e$$

where:

X is at least one element selected from the group consisting of Ag, Cu, Sn,

Y is at least one element selected from the group consisting of Pb, Zn,

Z is at least one element selected from the group consisting of Ni, Te,

R comprises additions of Bi, Sb, Ga and standard residues, and where the following values apply to a, b, c, d, e:

$70\% \leqq a \leqq 98\%$, $b \leqq 25\%$, $c \leqq 25\%$, $d \leqq 20\%$, $e \leqq 15\%$, and wherein it is furthermore the case that 2%≦b, if c=0%,
5%≦b, if X is Cu,
d≦5%, if Z is Ni, and
e≦5%, if R is Ga.

The masteralloy, as it is known, is a metal mixture or alloy which is to be processed together with Hg to form the amalgam, may be added to the lamp separately from the Hg and combines with the Hg in the lamp.

In principle, a relatively high In content is to be maintained in the masteralloy (the term alloy in this context is to be understood in a general sense as being a collective term for metal mixtures of a very wide range of types, but in particular for actual alloys). The In content is within the boundaries indicated for the stoichiometric parameter a, i.e. between 70% and 98%. Preferred upper limits are furthermore 97.5% and 97%. Preferred lower limits are 75%, 80%, 85%, 90%, 92%. In the context of the masteralloy contents, % details in this description and in the claims fundamentally mean percent by mass.

In this context, it should be noted that the stoichiometry parameter a here also contains additions of in particular Bi, Sb and Ga of up to 15%, in the case of Ga up to 5%. The actual lower limit for the In content itself is therefore 55%.

The additions of Bi, Sb or Ga do not significantly interfere with the invention but also do not perform any significant function of their own.

The contents of Ag, Cu and/or Sn, combined under S, have the function of widening the melting range. This is done by introducing multiphase states in the masteralloy. Particular preference is given in this context to Ag, or under certain circumstances also combinations with Cu and/or Sn. The corresponding stoichiometry parameter b according to the invention is at most 25%. The upper limits 20%, 15%, 12%, 10%, 8% are preferred. If the component Y, which is explained in more detail below, is not present, i.e. c=0%, b should amount to at least 2%. Furthermore, if Cu is selected for X, b should amount to at least 5%. Moreover, irrespective of the above, the lower limits of 2%, 2.5%, 3% and 3.5% are preferred; b may also be less than 2% or 0%, i.e. X can be substantially or completely dispensed with if the component Y mentioned below is present.

The component summarized under Y has the function of shifting the upper limit of the melting range towards higher temperatures. In particular in this way, if desired, the upper limit of a typical vapor pressure range that can be used can be increased up to about 4 Pa of the order of magnitude around 145° C. to 160° C. or 170° C. In this context, Pb is preferred over Zn, since Zn can lead to blackening. According to the invention, the corresponding stoichiometry parameter c is less than 25%. Preferred upper limits are 20%, 18%, 16%, 14%, 12%, 10%. Since Y can also be dispensed with altogether in very good masteralloys, specifically if there is no need to shift the upper limit of the melting range, the value 0% is in particular also preferred in accordance with the invention.

In this context, high values of over 20% are of interest at relatively high lamp powers of over 100 W and/or with lamp geometries which result in a particularly high level of heat being introduced. One example of a geometry of this type is formed by the helical lamp, which is explained in still more detail below and also forms an exemplary embodiment. However, consideration may also be given to conventional linear lamps, in which the Hg source may be mounted in such a way that it experiences a relatively high level of heat introduction, for example from the electrode. However, the constituent Y is optional and not absolutely required by the invention.

Z indicates a further constituent. This constituent combines Ni and Te, which in a metallic solution or an intermetallic compound can create or improve pasty states of the amalgam. The corresponding increase in viscosity may be of relevance to handling of the amalgam and/or to preventing it from dropping or running out of the intended location in the lamp. Ni or Te have no significant importance to the vapor pressure of Hg or the amalgam formation. The usefulness of this addition is very much dependent on the way in which the amalgam is introduced and mounted in the lamp.

Preferred values for the stoichiometry parameter d are between 0% and 5% in the case of Ni and between 0% and 20% in the case of Te. In this case too, very good masteralloys can even dispense with Z altogether. Therefore, d=0% is also a value that is preferred according to the invention. If a relatively large quantity of Te is provided, the In content should tend to be in the upper range, preferably over 80%, better 85% and even better 90%.

The Hg content itself, which is not calculated as part of the masteralloy, is preferably between 3% and 20%. In standard cases, the lower value of 3% does not form a substantial reserve, and consequently values of over 7% and even better over 10% are preferred. Furthermore, it is preferable for the Hg content to be at most 15%.

These masteralloys can generate Hg amalgams, which in the desired temperature range or part of the latter deliver favorable vapor pressures of approximately 0.5-4 Pa, vapor pressures of between 1 and 2 Pa being preferred. The range from 0.5-0.7 Pa, on the one hand, and up to 4 Pa, on the other hand, corresponds to a light yield of at least 90% in many fluorescent lamps. By way of example, in the case of what are known as T8 lamps with a diameter of approximately 26 mm, vapor pressures of the order of magnitude of 1 Pa are favorable, whereas in the case of T5 lamps with diameters of 16 mm, 1.6 Pa tends to be preferred. However, in this context there is a tolerance range of approximately 20%, preferably 10%. It can be appropriately assumed that the lamp diameter of tubular lamps is inversely proportional to the preferred Hg vapor pressure.

One possible geometry of a lamp according to the invention includes a helix shape of the discharge vessel, i.e. a discharge tube, with a tube piece which is attached to the discharge tube being arranged inside the helix shape. The tube piece is attached to one end of the helix shape and extends substantially axially parallel inside the helix shape. The helix shape is preferably a double helix shape, i.e. is composed of two discharge tube parts which are each helical and meet at the respective end. The tube piece is then attached there. In addition to advantages as an exhaust tube, which are of no further interest in the context of the present invention, this tube piece serves as a location for a Hg source, which is therefore substantially surrounded by the helical discharge tube and "shielded" from the outside world. Accordingly, temperatures which are higher but also less dependent on ambient conditions and fluctuations therein may form here.

Another option is a conventional linear lamp, in particular one with a relatively small diameter of preferably at most 16 mm, i.e. what is known as a T5 lamp, or narrower. Linear lamps of this type, with relatively thin discharge tubes, can easily have tight assembly conditions, with the result that the Hg source may be exposed to higher temperatures than in the case of linear lamps with a larger tube diameter. In particular, a holder for the Hg source may be mounted in the region of the electrodes and their holder, as illustrated in more detail by the second exemplary embodiment.

BRIEF DESCRIPTION OF THE DRAWINGS

In the text which follows, the invention is explained by way of example with reference to the drawings. The individual features may also be pertinent to the invention in other combinations.

In detail.

PREFERRED EMBODIMENT OF THE INVENTION

The text which follows describes exemplary embodiments of lamps giving possible uses for gas fills adapted for higher temperature ranges.

Figure 1A:
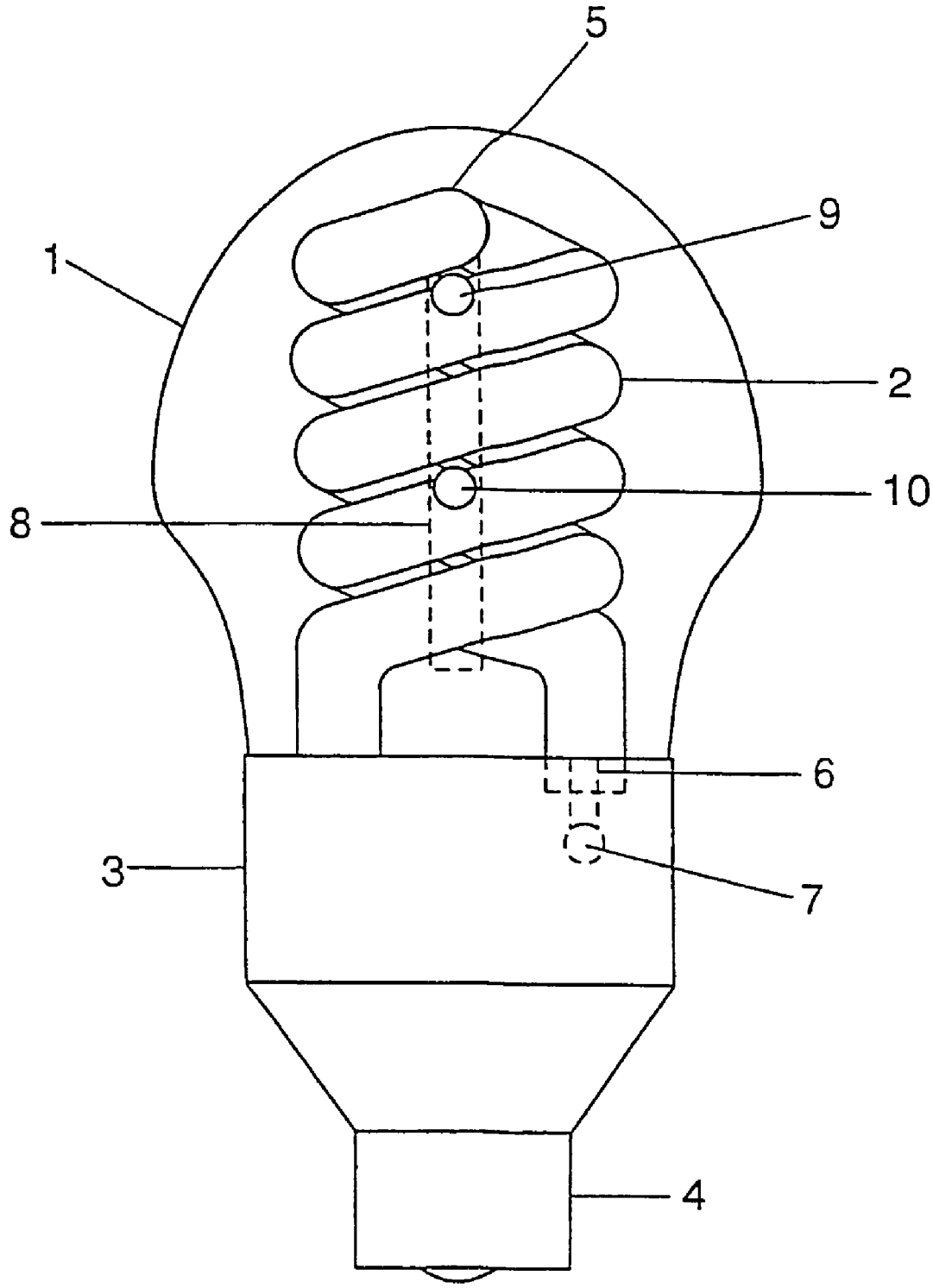
FIG. 1*a* shows a schematic elevation view of a compact fluorescent lamp, clearly illustrating a first possible use of the invention as distinct from the prior art.

FIG. 1*a* shows an elevation view of a compact fluorescent lamp, on the basis of which both the prior art and the invention are to be illustrated. The lamp has an outer bulb 1, which surrounds a helically wound discharge tube 2. The discharge tube 2 is connected to an electronic ballast 3, only the housing of which is illustrated and to the housing of which the outer bulb 1 is also secured. On the opposite side from the outer bulb 1, the housing of the ballast 3 ends in a standardized lamp cap 4. As described thus far, the lamp from FIG. 1*a* is conventional. The same also applies to the shape of the discharge tube 2, which has already been referred to above as a double helix and is wound with two ends starting from the ballast, in two discharge tube parts, to form a double helix with an alternating sequence of the helix turns of the two discharge tube parts. The two discharge tube parts merge into one another in an upper region, at a point denoted by 5.

FIG. 1*a* illustrates that compact fluorescent lamps of this type, despite compact external dimensions and a shape very similar to that of conventional incandescent lamps, overall provide a relatively large discharge length.

Reference 6 illustrates a conventional exhaust tube attachment at one of the two discharge tube ends, the circle indicated by 7 being intended to illustrate that a Hg source which regulates the vapor pressure, for example a ball of amalgam, may be provided here. The exhaust tube attachment serves, in a manner known per se, for evacuation of the discharge vessel and for filling it with the gas fills, which are discussed in more detail below. Further details, with which a person skilled in the art will be entirely familiar, such as the electrodes, fused disk seals or pinches, are not illustrated in more detail here. However, FIG. 1*a* does illustrate that the pump tube attachment 6 conventionally has a significantly smaller diameter than the discharge tube 2. Moreover, it must actually also leave space for the electrodes, which is not shown in this drawing. Furthermore, the exhaust tube attachment 6 on one side projects into the discharge tube end and on the other side projects out of the latter into the ballast, so that it requires a certain additional length (in the vertical direction in FIG. 1*a*) both on the side of the discharge tube and on the side of the ballast. In particular, the electrodes have to project beyond that part of the exhaust tube attachment 6 which projects into the discharge tube. In the prior art, they are in this case often stabilized by an additional bead of glass.

Finally, it will be clear that the temperature of the Hg source 7 accommodated in the exhaust tube attachment 7 is highly dependent on the ambient temperature in the ballast housing, which in turn depends on the external ambient temperature, the operating time and also the installation position of the lamp.

The line which is indicated in dashed form and is denoted by 8 illustrates a tube piece according to the invention which is attached to the discharge tube 2 in the region of the connection 5 between the two discharge tube parts and extends axially straight downward starting from this uppermost, axial position with respect to the helix. In this case, it substantially takes up the axial length of the helix shape.

Positions 9 and 10, which are each marked with a circle, illustrate two possible examples for the arrangement of a Hg source which regulates the vapor pressure in the tube piece 8 according to the invention. One position 9 is located slightly below the connection 5 of the discharge tube parts, i.e. already in the interior of the helix but in its upper region.

The other position 10 is located approximately in the center of the helix as seen in the axial direction (with the helix extending from the bottom bend of the discharge tube parts to the connecting position 5). At both positions, but in particular at the preferred position 10, the temperature of a Hg source in the helix is substantially determined by the radiation emanating from the discharge tube 2, since it is to a certain extent enclosed by the helical discharge tube 2. This approximately represents a radiating cylinder casing.

Based on the axial length of the helix, the position 9 should be at a good 20% and the position 10 at a good 50%. Both positions demonstrate the advantage of a rapid approach to the final temperature after the cold lamp has been switched on. Compared to the prior art, both positions are significantly less sensitive to fluctuations in the ambient temperature and changes in the installation position. However, position 10 is even less dependent on the orientation of the lamp in operation, i.e. on the question of whether the discharge lamp 2 in operation is arranged above, to the side of or below the ballast 3 and also on the different convection conditions which ensue.

It can be seen clearly from FIG. 1*a* that the exhaust tube function for filling with the gas fills according to the invention can also be performed by the tube piece 8 according to the invention, specifically via its lower end in FIG. 1*a*. This not only provides a large exhaust cross section, since it is not fitted into the discharge tube 2 and there is no need to take into account electrodes and other parts. Moreover, it is also readily accessible. Finally, the tube piece 8 according to the invention can, if desired, also be used in combination with conventional exhaust tubes 6 for purging operations and the like, and can furthermore (irrespective of conventional pump tubes 6) serve as a holder, for example if fused disk seals or pinches are arranged at the lower ends of the discharge tube 2.

Figure 1B:
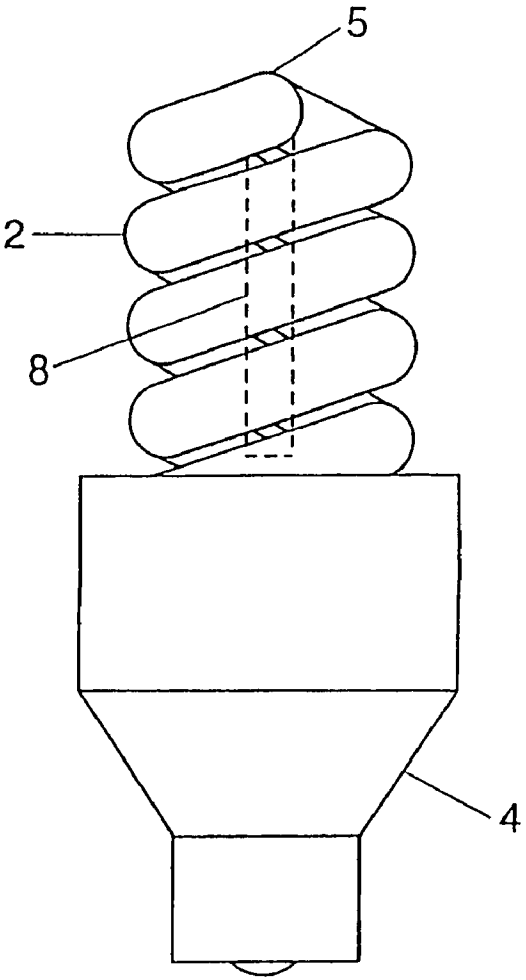
FIG. 1*b* shows a variant of FIG. 1*a*.

FIG. 1*b* shows a variant on FIG. 1*a*, in which the same reference designations are used for corresponding parts of the lamp, but not all the details are shown. Unlike FIG. 1*a*, this is a lamp without an outer bulb, in which, moreover, the discharge tube ends in the double helix form run into the cap 4. For comparison, reference is made to FIG. 2*b*, which is described in more detail below. It will be readily apparent that the lamp from FIG. 1*b* is of particularly compact construction.

Figure 2B:
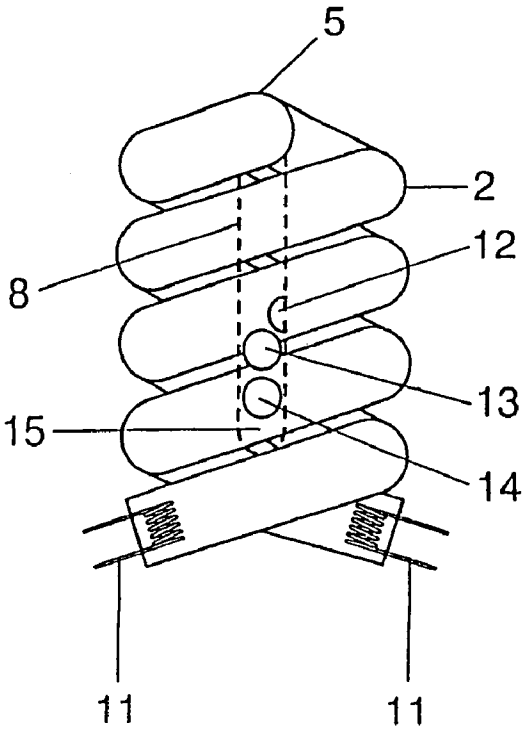
FIG. 2*b* shows a variant of FIG. 2*a* corresponding to FIG. 1*b*.
Figure 2A:
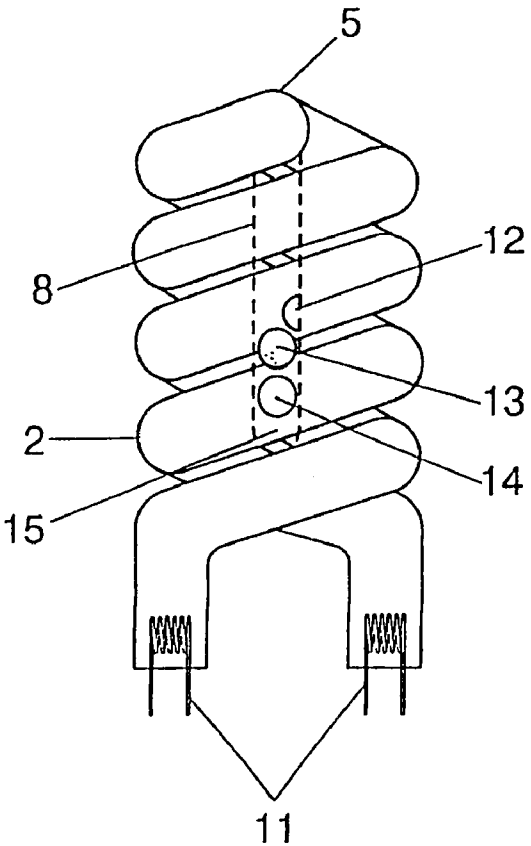
FIG. 2*a* shows a schematic elevation view of a discharge tube and tube piece according to the invention for a compact fluorescent lamp as in FIG. 1*a*.

FIG. 2*a* shows a discharge tube 2 corresponding to FIG. 1*a*, with a tube piece 8 which is similar to FIG. 1*a* and once again runs axially through the interior of the helix shape. FIG. 2*a* also schematically illustrates electrodes 11 at the discharge tube ends. The outer bulb 1, the ballast 3 and the cap 4 are not included in the drawing, however.

The tube piece 8 in this case does not extend over the entire length of the helix, but rather only over about ¾ thereof. It includes a fused glass seal 12, which serves to prevent a retaining body in the form of an iron pill 13 from dropping into the discharge tube 2. The iron pill 13 in turn, as a result of surface tension effects and because it blocks a large part of the cross section of the tube piece 8, prevents a ball of amalgam 14 from falling into the discharge tube 2. The ball of amalgam 14 as Hg source in this example is located at between approximately 60 and 70% of the axial length of the helix (measured from the top). The use of the iron pill 13 as retaining body 13 in particular allows the fused seal 12 to be configured in such a way that prior to insertion of the iron pill 13 and the ball of amalgam 14 it provides a good exhaust cross section through the tube piece 8 if the latter is used as an exhaust tube. Specifically, the iron pill 13 and the ball of amalgam 14 are only introduced after all the process steps of purging, pumping, forming, etc. have ended. After it has been used as an exhaust tube, the tube piece 8 is closed at its lower end by being fused shut, as is intended to be indicated by the shape of the end denoted by 15. Before being closed, the iron pill 13 and the ball of amalgam 14 have been introduced and then trapped in the space between the closure 15 and the fused seal 12. The statements made in connection with the position 10 in FIG. 1*a* also apply to the positioning of the ball of amalgam. In the region of the ball of amalgam 14, the tube piece 8 has an IR-absorbing outer coating (not shown in the drawing).

FIG. 2*b* shows a variant of FIG. 2*a* corresponding to the lamp from FIG. 1*b*, with the same reference designations having been used once again.

Ultimately, depending on the lamp power, temperatures of the ball of amalgam 14 of over 100° C., and therefore well above the range that is customary, result in operation. These temperatures may rise as high as the range from 160-170° C. A discharge lamp of this type can be operated without problems using the alloys according to the invention.

The text which follows describes a linear lamp of diameter T5, i.e. with a diameter of 16 mm, in which relatively high temperature ranges of the working amalgam also result.

Figure 3:
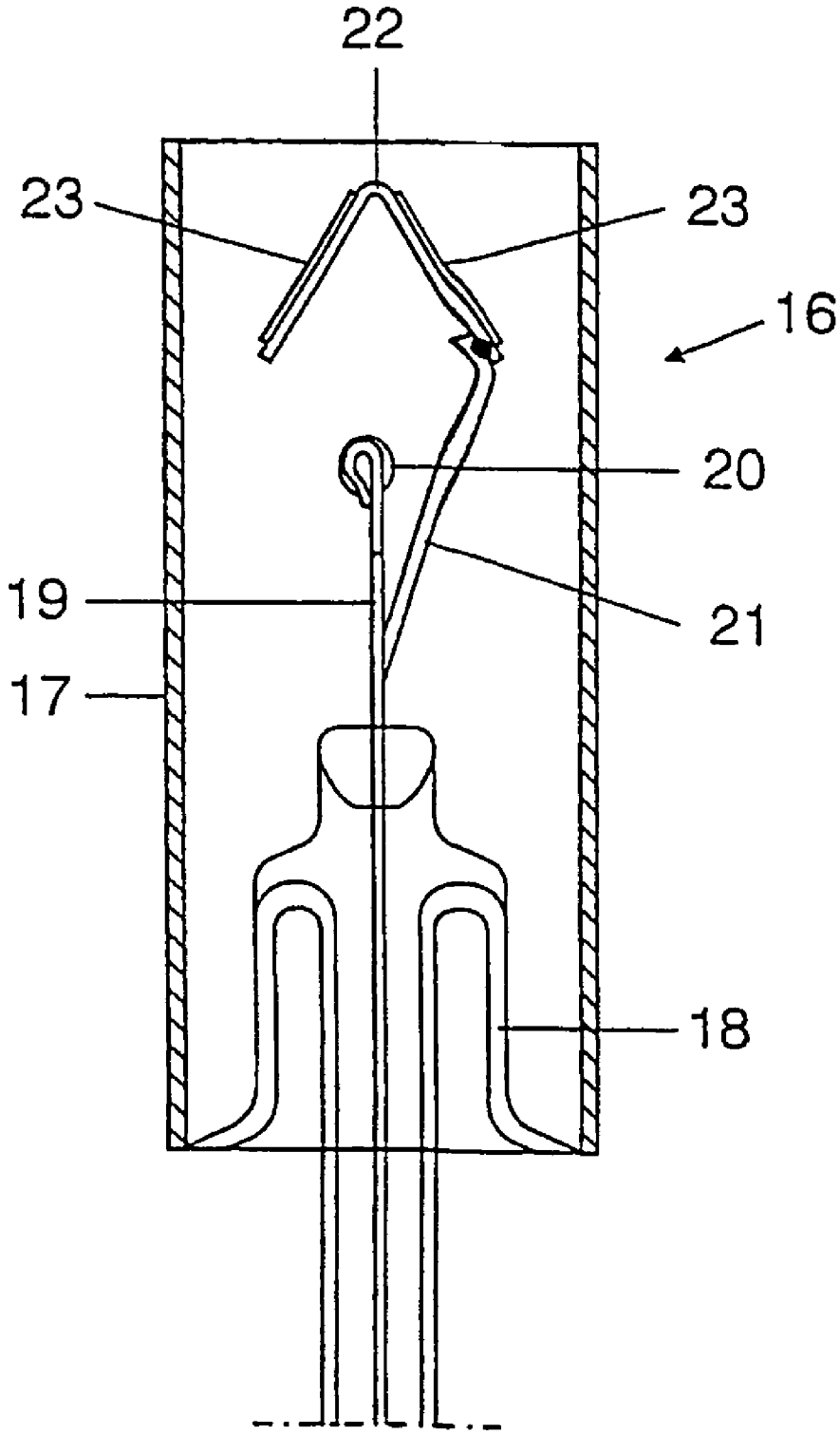
FIG. 3 shows a schematic elevation view of an end portion of a straight, tubular fluorescent lamp, clearly illustrating a further possible use of the invention.

FIG. 3 shows an elevation view of one end of a straight, tubular fluorescent lamp 16 without a cap. The free end of the tubular vessel 17 of the fluorescent lamp 16 is closed off by a fused plate seal 18, into which supply conductors 19 are pinched. At their inner ends, the supply conductors carry a filament 20. A wire 21, which at its free end carries a metal sheet 22 angled off in a roof shape, has been soldered to one supply conductor 19 between the fused plate seal 18 and the filament 20. The wire has been bent in such a way that the metal sheet 22 is arranged before the filament 20, as seen in the discharge direction.

A masteralloy 23 consisting of 96% In and 4% Ag has been applied to the metal sheet. During filling, sufficient Hg is added to the lamp for the Hg concentration of the mercury amalgam composed of the masteralloy and the mercury fraction, in this type of straight tubular fluorescent lamp, to be 12% at the start of the operating time. Over the course of the service life, the Hg concentration drops to 3% as a result of the consumption of Hg.

Further details will emerge from a more detailed description given in an earlier family of patents held by the applicant, namely documents WO 98/14983, U.S. Pat. No. 6,043,603, EP 0 888 634, JP 11 500 865 T2 and related documents.

The following examples have proven suitable working amalgams for the elevated temperatures in use in the lamps described above:

as a first exemplary embodiment, a content of 10 parts by weight of Hg with a masteralloy comprising 97% by weight In and 3% Sn is used, i.e. the masteralloy is written as $In_{97}Sn_3$. Here, Sn was selected as element X, although Ag is comparatively preferred. Furthermore, a relatively low value of 3% by weight Sn is used in this case, although values of over 3.5% by weight are even more favorable.

A further example contains the masteralloy $In_{96}Cu_4$. In this case, the stoichiometry parameter for the element X is already in the particularly preferred range. However, in this case Cu was selected for the element X.

Furthermore, an amalgam in which the masteralloy $In_{88}Pb_{12}$ was used was tested and found to be suitable. The Pb content is relatively high and no longer in the particularly preferred range. However, the Pb content meant that it was possible to dispense with the addition of X altogether.

Another example which was used in the helical lamp described in more detail below has a smaller Pb content of 10% by weight, i.e. a masteralloy $In_{90}Pb_{10}$. In this case, however, a ratio of 3% by weight Hg to 97% by weight masteralloy is used.

A second amalgam used with the helical lamp explained below uses the masteralloy $In_{96}Ag_4$ (with 10% by weight Hg), i.e. does without the element H and selects the element Ag which is actually the most preferred element for X.

Further examples are masteralloys $In_{84}Ag_6Pb_{10}$ and $In_{84}Ag_7Pb_9$.

Ni or Te can in each case be added to these latter masteralloys to increase the viscosity or ductility, specifically for example as follows:

$$In_{80}Ag_6Pb_{10}Ni_4,\ In_{81}Ag_7Pb_9Ni_3,\ In_{72}Ag_6Pb_{10}Te_{12},\ In_{70}Ag_7Pb_9Te_{14}.$$

Additions of the element R do not bring any technical benefit and are therefore not envisaged for preferred masteralloys.

However, it has emerged that in the lamps described, difficulties may occur with the amalgams described during attempts at starting at relatively low temperatures. The ignition voltages rise significantly, and the operating voltages may also be relatively high at low dimming levels of the inherently dimmable low-pressure discharge lamps according to the present invention. This imposes increased demands on electronic ballasts, which, however, can be avoided using gas fills according to the invention.

Figure 4:
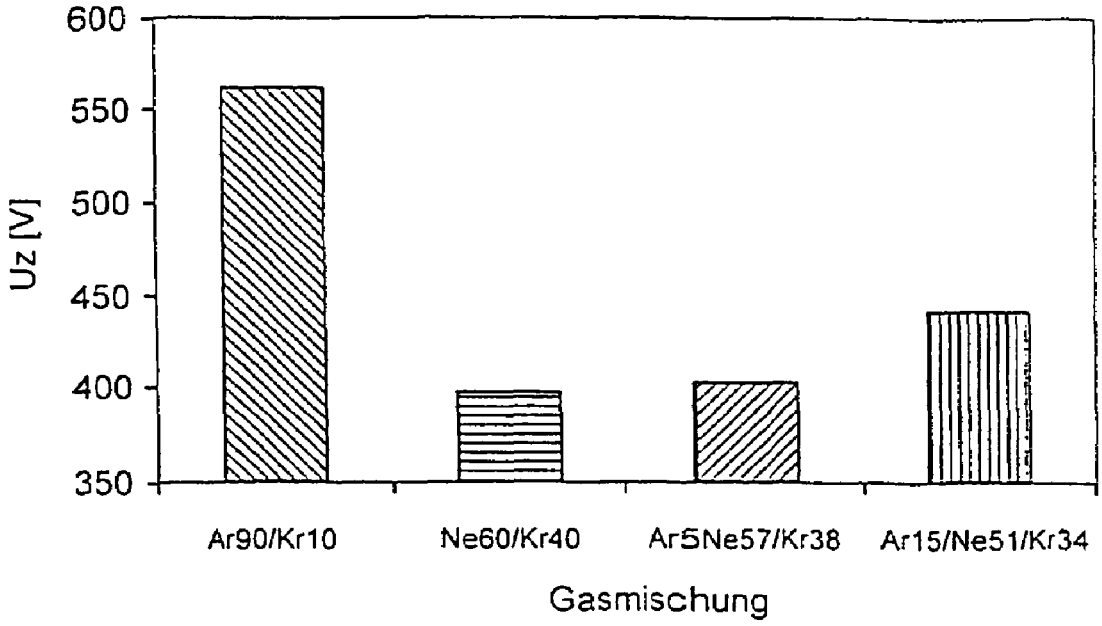
FIG. 4 shows a schematic diagram comparing the ignition voltages of gas fills according to the invention with a conventional gas fill.

FIG. 4 shows, as an example, a schematic illustration of the ignition voltages of various gas fills. The vertical axis shows the ignition voltage in volts, while the various gas fills are plotted on the horizontal axis. The four gas fills illustrated serve to provide a comparative illustration. The second to fourth gas fills (from the left) are in accordance with the invention, while the gas fill on the far left is not in accordance with the invention. The latter consists of 90% by volume of Ar and 10% by volume of Kr. The ignition voltage applies to a negligible Hg vapor pressure, i.e. as it were to a low-temperature limit value. Although in practice finite, albeit relatively low Hg vapor pressures are of course to be taken into account, the qualitative results are quite clear from FIG. 4.

The resulting value of over 550 V is unfavorable for the circuitry of the ballast. The mixture of 60% by volume Ne and 40% by volume Kr, which is also illustrated, shows that with suitable matching between these two noble gases, it is possible to achieve ignition voltages which are significantly lower but not too low, in the present case just below 400 V. However, it has emerged that a residual Ar content is advantageous for the efficiency of light generation. The third gas fill illustrated therefore contains 5% by volume Ar, with reduced Ne and Kr contents compared to the second gas fill.

In the fourth example, illustrated on the far right, 15% by volume of Ar is present, with correspondingly reduced Ne and Kr contents of 51% by volume and 34% by volume, respectively. The range between 5 and 15% by volume Ar is considered particularly expedient according to the invention. At levels below 5% by volume, there is no longer any significant effect on the efficiency of light generation, whereas at levels over 15% by volume, the operating voltage becomes increasingly high, as has already been illustrated in FIG. 4.

Figure 5:
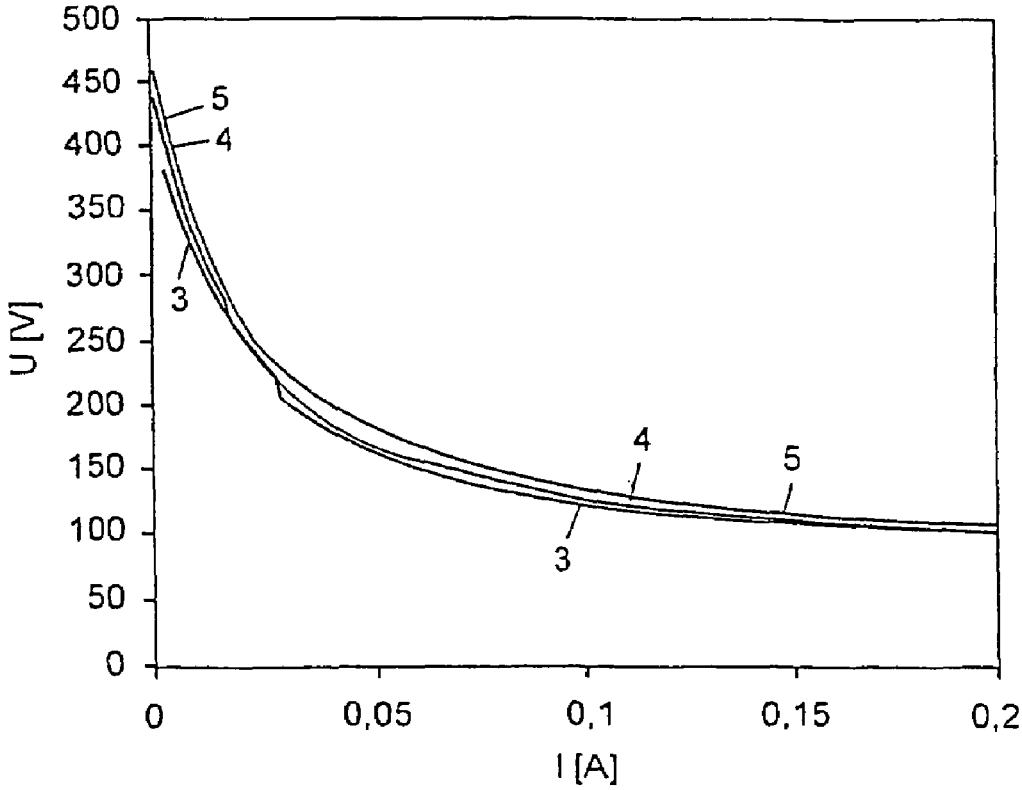
FIG. 5 shows a schematic diagram illustrating current/voltage characteristic curves for lamps according to the invention compared to the prior art.

For comparison, FIG. 5 shows the third gas fill (characteristic curve 3, 5% by volume Ar, 57% by volume Ne, 38% by volume Kr) and the fourth gas fill (characteristic curve 4, 15% by volume Ar, 51% by volume Ne, 34% by volume Kr) from FIG. 4 as well as pure Ar (characteristic curve 5), in each case as a current/voltage characteristic curve, i.e. a dimming characteristic curve, of a 54 W linear lamp according to FIG. 3, indicating the current I in A and the operating voltage U in V. It is clearly apparent that in particular in the range of relatively low lamp currents, i.e. relatively low operating voltages, compared to pure Ar, significant voltage reductions result, which are of benefit to the stability of current or power control of dimming operation and the design of the electronic ballast. It can also be seen from this figure that the gas fill according to the invention with the higher Ar content of 15% by volume exhibits this advantage to a lesser extent than the gas fill containing 5% by volume Ar, which is likewise in accordance with the invention. On the other hand, these characteristics are reversed with regard to the efficiency of light generation. Therefore, a suitable compromise has to be found for each individual situation.

The gas fills according to the invention presented here do not contain any further noble gases, and only insignificant levels of impurities. In the above examples for the gas fills, a Ne to Kr ratio of approximately 3:2 was maintained. It is also possible to deviate from this ratio, in which case a higher Ne content increases the operating voltage and a higher Kr content reduces the operating voltage.

The invention claimed is:

1. A low-pressure gas discharge lamp having a discharge vessel and a gas fill in the discharge vessel wherein the gas fill consists of:

46% by volume to 60% by volume Ne,

5% by volume to 15% by volume Ar, up to 2% by volume further noble gases and standard impurities, and remainder Kr.

2. The lamp as claimed in claim 1, in which the lower limit for the Ne content in the gas fill is 48% by volume, and the upper limit is 57% by volume.

3. The lamp as claimed in claim 1, having a Hg amalgam as the Hg source which regulates the vapor pressure, which lamp is designed in such a way that the Hg amalgam in normal operation reaches a temperature of 100° C. to 170° C.

4. The lamp as claimed in claim 1, having a discharge tube (2) which is at least partially wound helically around a free axial space, and having a tube piece which is attached to the discharge tube, the tube piece being attached to the discharge tube at one end of the helix shape and from there extending substantially axially parallel inside the helix shape, and the tube piece containing at least one Hg source and the Hg source being arranged inside the helix shape.

5. The lamp as claimed in claim 1, which is configured as a linear lamp with an elongate discharge vessel.

6. The lamp as claimed in claim 5, in which the discharge vessel has a tube diameter of at most 16 mm.

7. The lamp as claimed in claim 3, in which the Hg amalgam is formed from a Hg fraction and a masteralloy, the masteralloy corresponding to the general formula $In_{a-e}X_bY_cZ_dR_e$ where:

X is at least one element selected from the group consisting of Ag, Cu, Sn,

Y is at least one element selected from the group consisting of Pb, Zn,

Z is at least one element selected from the group consisting of Ni, Te,

R comprises additions of Bi, Sb, Ga and standard residues, and where the following values apply to a, b, c, d, e: $70\% \leqq a \leqq 98\%$, $b \leqq 25\%$, $c \leqq 25\%$, $d \leqq 20\%$, $e \leqq 15\%$, and wherein it is furthermore the case that $2\% \leqq b$, if $c=0\%$, $5\% \leqq b$, if X is Cu, $d \leqq 5\%$, if Z is Ni, and $e \leqq 55\%$, if R is Ga.

* * * * *

UNITED STATES PATENT AND TRADEMARK OFFICE

CERTIFICATE OF CORRECTION

PATENT NO. : 7,948,182 B2
APPLICATION NO. : 11/989524
DATED : May 24, 2011
INVENTOR(S) : Martin Beck et al.

It is certified that error appears in the above-identified patent and that said Letters Patent is hereby corrected as shown below:

Column 10, line 43, delete "and e≤55%" and insert in place thereof -- and e≤5% --

Signed and Sealed this
Nineteenth Day of July, 2011

David J. Kappos

David J. Kappos
*Director of the United States Patent and Trademark Office*